US007009602B2

(12) United States Patent
Nakamura

(10) Patent No.: US 7,009,602 B2
(45) Date of Patent: Mar. 7, 2006

(54) METHOD OF DRIVING PLASMA DISPLAY PANEL

(75) Inventor: Tadashi Nakamura, Tokyo (JP)

(73) Assignee: Pioneer Corporation, Tokyo (JP)

( * ) Notice: Subject to any disclaimer, the term of this patent is extended or adjusted under 35 U.S.C. 154(b) by 672 days.

(21) Appl. No.: 09/891,664

(22) Filed: Jun. 27, 2001

(65) Prior Publication Data

US 2002/0015012 A1 Feb. 7, 2002

(30) Foreign Application Priority Data

Jun. 28, 2000 (JP) ..... 2000-194295

(51) Int. Cl.
*G09G 5/00* (2006.01)

(52) U.S. Cl. ..... 345/209; 345/213; 345/60

(58) Field of Classification Search ..... 345/60, 345/61, 204, 208, 209, 211, 212, 213
See application file for complete search history.

(56) References Cited

U.S. PATENT DOCUMENTS 6,483,487 B1 * 11/2002 Iseki ..... 345/60
6,489,939 B1 * 12/2002 Asao et al. ..... 345/65
6,531,995 B1 * 3/2003 Ishii et al. ..... 345/67

FOREIGN PATENT DOCUMENTS

| | | |
|---|---|---|
| JP | 9-244573 | 9/1997 |
| JP | 10-3280 | 1/1998 |
| JP | 10-207417 | 8/1998 |
| JP | 2000-39866 | 2/2000 |
| JP | 2629944 | 4/2000 |

* cited by examiner

*Primary Examiner*—Kent Chang
(74) *Attorney, Agent, or Firm*—Sughrue Mion, PLLC

(57) ABSTRACT

A method of driving a plasma display panel including a plurality of mutually parallel first electrodes, and a plurality of second electrodes separated from and perpendicular to the first electrodes, the intersection points of neighboring pairs of the first electrode pairs and the second electrode pairs forming an unit display cell, includes the step of reversing the potentials between the electrodes at the time of write discharge carried out between the odd-numbered the first electrodes and even-numbered the first electrodes, and the second electrodes, to each other.

25 Claims, 16 Drawing Sheets

P1 : PRIMING DISCHARGE PULSE
P2 : PRIMING DISCHARGE REMOVAL PULSE
P3 : SCAN PULSE
P4 : SCAN BASE PULSE
P5 : SUSTAIN PULSE
P6 : SUSTAIN REMOVAL PULSE
P7 : SCAN PULSE
P8 : SUSTAIN PULSE
P9 : DATA PULSE
P10 : DATA BASE PULSE
P11 : DATA PULSE

P1 : PRIMING DISCHARGE PULSE Pp1
P2 : PRIMING DISCHARGE ELIMINATION PULSE Ppe
P3 : SUSTAIN PULSE
P4 : PRIMING DISCHARGE PULSE Pp2
P5 : SCAN PULSE
P6 : SUSTAIN PULSE
P7 : PRIMING DISCHARGE ELIMINATION PULSE Ppe
P8 : PRIMING DISCHARGE PULSE Pp3
P9 : DATA PULSE

P1 : PRIMING DISCHARGE PULSE
P2 : PRIMING DISCHARGE REMOVAL PULSE
P3 : SCAN PULSE
P4 : SCAN BASE PULSE
P5 : SUSTAIN PULSE
P6 : SUSTAIN REMOVAL PULSE
P7 : SCAN PULSE
P8 : SUSTAIN PULSE
P9 : DATA PULSE
P10 : DATA BASE PULSE
P11 : DATA PULSE

P1 : PRIMING DISCHARGE PULSE
P2 : PRIMING DISCHARGE REMOVAL PULSE
P3 : SCAN PULSE
P4 : SCAN BASE PULSE
P5 : SUSTAIN PULSE
P6 : SUSTAIN REMOVAL PULSE
P7 : SCAN PULSE
P8 : SUSTAIN PULSE
P9 : DATA PULSE
P10 : DATA PULSE

P1 : PRIMING DISCHARGE PULSE
P2 : PRIMING DISCHARGE REMOVAL PULSE
P3 : SCAN PULSE
P4 : SCAN BASE PULSE
P5 : WRITE CANCEL PULSE
P6 : SUSTAIN PULSE
P7 : SUSTAIN REMOVAL PULSE
P8 : WRITE CANCEL PULSE
P9 : SCAN PULSE
P10 : SUSTAIN PULSE
P11 : DATA PULSE
P12 : DATE BASE PULSE
P13 : DATA PULSE

METHOD OF DRIVING PLASMA DISPLAY PANEL

BACKGROUND OF THE INVENTION

1. Field of the Invention

This invention relates to plasma display panels, and especially to a method of driving plasma display panels.

2. Description of the Related Art

In general, a plasma display panel (abbreviated to "PDP" below) has a flat structure and a high display contrast without flickering. Moreover, it has many characteristics: for example, it can be made into a relatively big screen, it has a fast response, and, being of the self-fluorescent type, it can be made to fluoresce in multi-color by the use of phosphors. For this reason, its application has been expanding in the fields of large size public display device and color television, etc., in recent years.

By its method of operation, PDP has the alternating current discharge type (AC type), in which, the electrodes are covered by a dielectric substance, and is operated by a condition of alternating current discharge indirectly, and the direct current discharge type (DC type), in which, the electrodes are exposed to the discharge space, and is operated by a condition of direct current discharges. Furthermore, in the alternating current discharge type, there is the memory drive type that uses the memory of the discharge cells as its drive method, and the refresh drive type that does not use that method. Moreover, the brightness of PDP is approximately proportional to the number of discharges, that is, the repetition number of the pulse voltage, regardless of the memory drive type or the refresh drive type. In the case of the refresh drive type, as the display capacity becomes larger, brightness decreases and it is mainly used for PDP with small display capacity.

FIG. 1 is a perspective exploded view showing an example of the structure of the display cells in an alternating current discharge memory drive type PDP that is disclosed in Japanese Patent No. 2629944 (Japanese Unexamined Patent Publications No. 2-220330) and Japanese Unexamined Patent Publication No. 2000-39866.

This PDP seals the discharge gas in between two insulator plates 1 and 2 of the front surface and the rear surface made of glass plates. On the internal surface of the insulator plate 2, the transparent sustain electrodes 3 and the bus electrodes 4, which are placed coincident with the sustain electrodes 3 to reduce electrode resistance, are formed.

On the dielectric substance layer 11 between the separation walls 7, and the side surfaces of the separation walls, phosphor 8 is coated. To display the various colors, the phosphor 8 is painted and arranged into the three primary colors of red, green, and blue. In between the insulator plates 1 and 2, a discharge gas space 6 filled with a discharge gas of helium, neon, xenon and the like, or combinations thereof, is formed.

The ultraviolet light generated by the discharge of the foregoing discharge gas is converted into the visible light 12 by the phosphor 8.

The vertical separation walls are formed in between the neighboring data electrodes 5, and the horizontal separation walls are formed along the bus electrode 4 of every sustain electrode 3, cutting across the center part. Every sustain electrode 3 becomes an electrode shared by the upper and lower display cell.

FIG. 2 shows a vertical cross-sectional view of the display cells in the alternating current discharge memory drive type PDP shown in FIG. 1. The discharge operation of the selected display cells will be explained with reference to FIG. 2.

When a pulse voltage that is higher than the discharge start voltage between the sustain electrode 3 on one side of every display cell and the data electrode 5, is applied to start the discharge, according to the polarity of this pulse voltage, positive and negative electrical charges are attracted to the internal surface of the dielectric substance layers 9 and 11 on both sides, and an accumulation of electrical charges occurs.

The equivalent internal voltage due to the accumulation of electrical charges, that is, the wall voltage, decreases the effective voltage inside the cell as well as the growth of the discharge, because of its opposite polarity to the foregoing pulse voltage. Even if the foregoing pulse voltage maintains a constant value, the discharge cannot be maintained, and will eventually stop.

After that, a sustain discharge pulse that is a pulse voltage of the same polarity as the wall voltage is applied between a neighboring sustain electrode pair and as the contribution of the wall voltage, being an effective voltage, is superimposed and even the voltage amplitude of the sustain discharge pulse is low, thus, discharge start voltage can be superseded and discharge occurs.

Consequently, by continuing the application of the sustain discharge pulse between the sustain electrode pair alternatively, it is possible to maintain the discharge. This function is the aforementioned memory function.

FIG. 3 is an explanatory drawing showing the schematic structure of the PDP formed by arranging in a matrix the display cells shown in FIG. 2.

PDP 13 is a dot matrix panel for display use, in which display cells 14 are arranged into m×n rows and columns. The sustain electrodes E1, E2, . . . , Em are placed mutually in parallel as row electrodes. The data electrodes D1, D2, . . . , Dn are placed orthogonally with respect to the sustain electrodes as column electrodes.

FIGS. 4 and 5A to 5E show respectively the drive waveform chart and modal drawing showing the change of the charged condition in the priming discharge period for the foregoing PDP disclosed in Japanese Patent Unexamined Publication No. 9-244573.

In FIG. 4, $W_{Ea}$, $W_{Eb}$, $W_{Ec}$, $W_{Ed}$ are sustain electrode drive pulses applied to the sustain electrodes Ea, Eb, Ec, Ed. $W_d$ is a data electrode drive pulse applied to data electrodes $D_i$ ($1 \leqq i \leqq n$). Sustain electrodes Ea indicates the (1+4K)-th sustain electrodes E1, E5, E9 . . . , and sustain electrodes Eb indicates the (2+4K)-th sustain electrodes E2, E6, E10 . . . , and sustain electrodes Ec indicates the (3+4K)-th sustain electrodes E3, E7, E11 . . . , and sustain electrodes Ed indicates the (4+4K)-th sustain electrodes E4, E8, E12. Here, K is 0 or a positive integer. In FIGS. 5A to 5E and later mentioned FIGS. 5F to 5H, the symbol [☆] in the figure represents discharge.

A drive period consists of a priming discharge period, a write discharge period, and a sustain discharge period. By repeating these, desired image displays can be obtained.

To obtain stabilized write discharge characteristics in the write discharge period, the priming discharge period is a period to reset the previous history, and to generate active particles and wall charges in the discharge gas space. The write discharge period is a period in which, according to the display data, the ON/OFF of the display cells are selectively discharged. The sustain discharge period is a period in which discharges in the display cells selected in the write discharge period are repeated, and brightness is controlled.

In the priming discharge period, the sustain electrodes are divided into four electrode groups. The first group consists of the combination of the (1+4K)-th sustain electrodes counting from one side (the side of the foremost line) of the electrode arrangement. The second group is the combination of the (2+4K)-th sustain electrodes. The third group is that of the (3+4K)-th sustain electrodes, and the fourth group is that of the (4+4K)-th sustain electrodes. Here, K is 0 or a positive integer. FIG. 4 shows the drive waveforms of these four groups of sustain electrodes Ea, Eb, Ec, Ed and the data electrodes.

First, at timing (a) of FIG. 4, priming discharge pulse Pp1 of positive polarity is applied to sustain electrodes Eb, Ed to produce discharges in all the lines. Through this, as shown in FIG. 5A, in between sustain electrodes Ea, Ec, and sustain electrodes Eb, Ed, the polarities of the wall charges are different, and between the two lines corresponding to each of the sustain electrodes, charge conditions of the same polarity are formed. That is, taking the separation walls as mirror surfaces, the charge condition at every sustain electrode has mirror symmetry. With the mirror symmetry intact, when a scan pulse Pw is applied to each electrode, two lines would have been selected.

To break the mirror symmetry, at timing (b) of FIG. 4, priming discharge pulse Pp2 of negative polarity is applied to the sustain electrode Eb, and at the same time, priming discharge pulse Pp3 of positive polarity is applied to the sustain electrode Ec. Moreover, at timing (c) of FIG. 4, priming discharge pulse Pp3 of positive polarity is applied to the sustain electrode Ea, and at the same time, priming discharge pulse Pp2 of negative polarity is applied to the sustain electrode Ed. The peak values of the priming discharge pulses Pp2, Pp3 are chosen to be values that would be sufficient to generate discharges only by applying both of the priming discharge pulses Pp2, Pp3, as illustrated in FIGS. 5 B and 5C.

By the above, as shown in FIG. 5C, in all the lines, in the dielectric substance layer inside a unit fluorescent domain, wall charges of the negative polarity exist on one side in the column direction. And on the other side, as wall charges of the negative polarity actually do not exist, a charge condition that charges the opposite polarity (positive polarity here) is formed.

Next, at timing (d) of FIG. 4, priming discharge elimination pulse Ppe of positive polarity is applied to the sustain electrodes Ea, Ec, and at timing (e), priming discharge elimination pulse Ppe of positive polarity is applied to the sustain electrodes Eb, Ed to produce elimination discharges to remove unwanted wall charges. Under this condition, if the sustain electrodes are sequentially selected one by one, and a scan pulse of negative polarity Pw is applied, in lines where wall charges of negative polarity exist, opposite discharges occur. Moreover, for practical line scans, selecting sequentially from the second sustain electrode in the electrode arrangement will be acceptable.

FIGS. 5F to 5H are drawings showing the charge conditions due to write discharge and sustain discharge.

FIG. 5F represents a summary of the write discharge of every display cell (timing (f)), and the charge condition is after the finish of the writing of all the display cells. At the end of priming discharge, on the parts of the sustain electrodes where charges are not accumulated, when scan pulses of negative polarity is applied to the neighboring sustain electrodes that, in pairs, form the display cells, to produce opposite discharges, because of the 0 V potential kept, negative charges accumulate.

At timing (g), when the first sustain pulses are applied to the sustain electrodes Ea, Ec, the wall charges formed by the write discharge will be superimposed onto the potential difference between the sustain electrodes due to the sustain pulse, sustain discharges occur in the display cells formed by Eb-Ec and Ed-Ea. That is, sustain discharges occur at every other line, and, as a result, the wall charges accumulated on each sustain electrode are unified to be positive or negative.

At timing (h), when the second sustain pulse is applied to the sustain electrodes Eb, Ed, as the wall charges in all display cells will be superimposed onto the potential difference between the sustain electrodes due to the sustain pulse, sustain discharges occur in all the written-in display cells.

After that, by applying sustain pulses alternatively onto Ea, Ec and Eb, Ed, sustain discharges are repeated simultaneously in all the written-in display cells.

In the foregoing conventional drive method, between the odd-numbered and even-numbered lines, there is difference in the number of discharges in the priming discharge period. Hence, in every drive period, techniques like shifting the application objects of the priming discharge pulses Pp2, Pp3 and the priming discharge elimination pulse Ppe with respect to the previous period is necessary.

Moreover, in the priming discharge period, as discharge occurs as much as three times, as shown in FIGS. 5A to 5E, therefore, there will be a lot of light emission. As light emission due to priming discharge becomes constant background brightness independent of the display data, degradation of contrast will result if it becomes too great.

Furthermore, while sustain discharge starts at every other line with a lag of one time, they all stop at the same time. As a result, in one drive period, the number of sustain discharges is different for every line, and brightness becomes different.

Japanese Unexamined Patent Publication No. 10-3280 has suggested a plasma display panel in which first electrodes are grouped into K-th electrodes and (K+1)-th electrodes wherein K is an even number, and second electrodes are grouped into M-th electrode and (M+1)-th electrodes wherein M is an even number. The K-th and (K+1)-th electrodes and the M-th and (M+1)-th electrodes are simultaneously driven in both reset and address periods. In sustain periods, a phase of a pulse in the K-th and M-th electrodes is retarded by 180 degrees relative to a phase of a pulse in the (K+1)-th and (M+1)-th electrodes.

Japanese Unexamined Patent Publication No. 10-207417 has suggested a method of driving a plasma display panel, in which reset discharges are carried out at different timings in fields, and a discharge is not carried out in a reset period in a discharge cell which does not contribute to displaying.

SUMMARY OF THE INVENTION

In view of the above-mentioned problems in the conventional plasma display panels, it is an object of the present invention to realize stabilized drive performance while continuing to suppress background brightness, and to control to a uniform brightness.

The present invention provides a method of driving a plasma display panel comprising a plurality of mutually parallel first electrodes, and a plurality of second electrodes separated from and perpendicular to the first electrodes, the intersection points of neighboring pairs of the first electrode pairs and the second electrode pairs forming an unit display cell, the method comprising the step of reversing the potentials between the electrodes at the time of write discharge carried out between the odd-numbered the first electrodes and even-numbered the first electrodes, and the second electrodes, to each other.

It is preferable that at the odd-numbered (even-numbered) first electrodes, a scan pulse of negative polarity from the first base potential is applied sequentially, and then corresponding to the scan pulse of negative polarity, at the second electrodes, a data pulse of positive polarity from the second base potential is applied, and at the even-numbered (odd-numbered) first electrodes, a scan pulse of positive polarity from the third base potential is applied sequentially, and then corresponding to the scan pulse of positive polarity, at the second electrodes, a data pulse of negative polarity from the fourth base potential is applied to carry out the write discharges.

It is preferable that at least one of the amplitude of the scan pulse of negative polarity and the amplitude of the scan pulse of positive polarity, and, the amplitude of the data pulse of positive polarity and the amplitude of the data pulse of negative polarity, are different.

It is preferable that the third base potential of the scan pulse of positive polarity is set at a higher potential than the first base potential of the scan pulse of negative polarity, and the second base potential of the data pulse of positive polarity and the reach potential of the data pulse of negative polarity are made to be the same potential, and the fourth base potential of the data pulse of negative polarity and the reach potential of the data pulse of positive polarity are made to be the same potential.

It is preferable that the first base potential of the scan pulse of negative polarity and the third base potential of the scan pulse of positive polarity are made to be at the same potential, and, the second base potential of the data pulse of positive polarity and the fourth base potential of the data pulse of negative polarity are made to be at the same potential.

It is preferable that among the two first electrodes neighboring the first electrode onto which a scan pulse is applied, onto the first electrode that constitutes the display cells on the side where write discharge has not occurred, a write cancel pulse is applied at the time of write discharge.

It is preferable that after the finish of write discharge in all the display cells, sustain discharges are carried out between the first electrodes neighboring all the display cells.

It is preferable that before the write discharge, a discharge period, in which the electrical charge conditions in all the display cells are reset, is set.

It is preferable that the discharge period, in which electrical charge conditions are reset, is a sustain elimination discharge that resets only the display cells that has sustain discharged in the previous sustain discharge period, or a priming discharge that causes discharges in all display cells, or a combination of sustain elimination discharge and priming discharge.

It is preferable that the priming discharges are made to occur simultaneously in all display cells, and the rise, or, time of rise, of the pulse that causes the occurrence of priming discharges is below 10 V/$\mu$s.

It is preferable that the second electrodes are set in an island form in every display cell, and the island-formed parts are positioned opposite the first electrodes that carry out the write discharges.

The advantages obtained by the aforementioned present invention will be described hereinbelow.

As explained above, by this invention, in PDP in which two neighboring display lines sharing a sustain electrode, the sustain electrodes are divided according to their odd or even order. As the wall charges on the sustain electrodes that are formed by write discharge are unified to be positive or negative, the start of sustain discharge can be made simultaneous in all the selected display cells. The brightness of every display line can be unified, and stabilized drive performance can be obtained.

Moreover, the setting of a discharge period that resets the charge conditions of all the display cells before the write discharge improves write discharge performance. Also, as the fluorescent brightness of priming discharge can be suppressed to be low, contrast is enhanced, and good picture quality can be obtained.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Preferred embodiments in accordance with the present invention will be explained hereinbelow with reference to drawings.

The embodiment of the invention will be described hereinbelow in detail with reference to the drawings.

Figure 1:
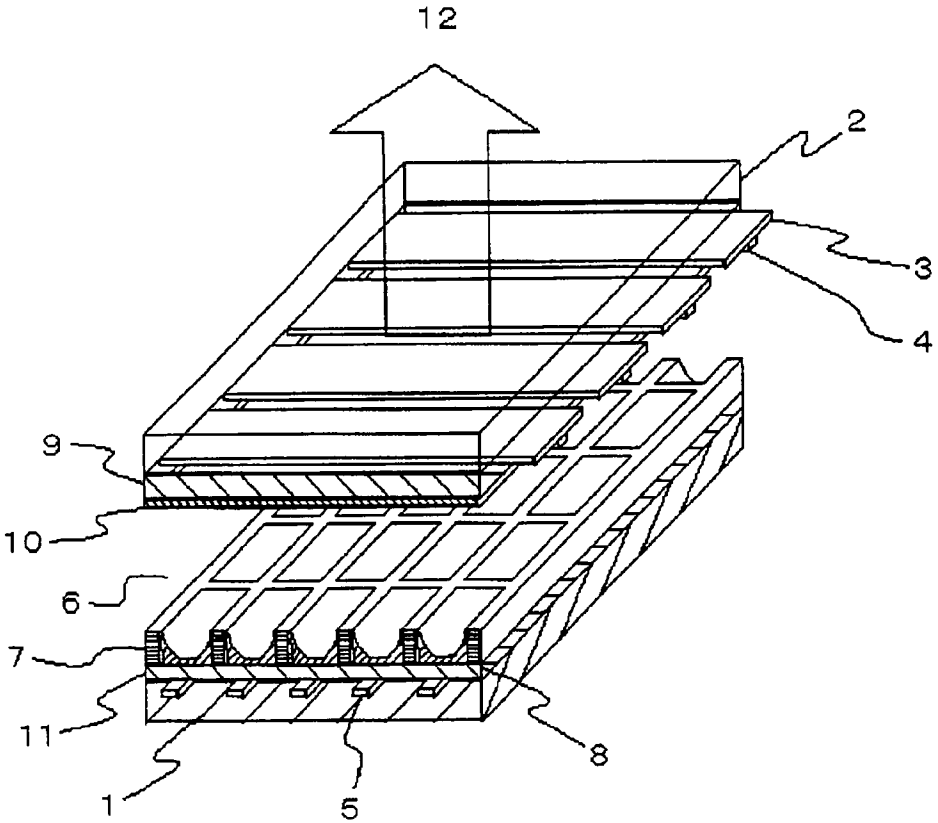
FIG. 1 PRIOR ART
FIG. 1 is a perspective exploded view of conventional PDP.
Figure 2:
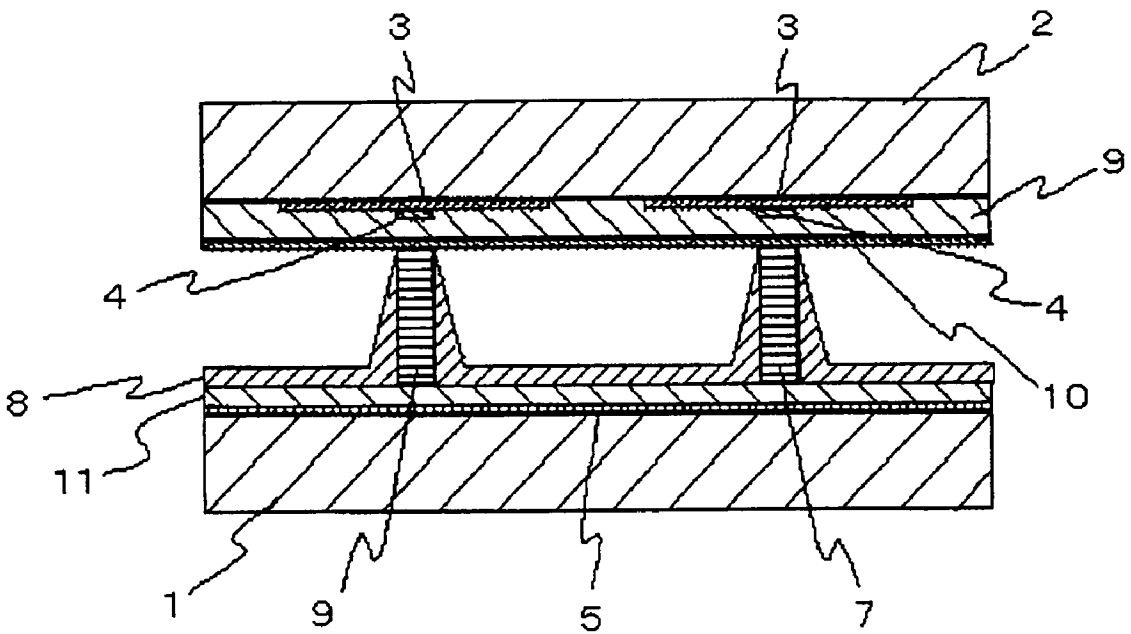
FIG.2 PRIOR ART
FIG. 2 shows a vertical cross-sectional view of the PDP shown in FIG. 1.
Figure 3:
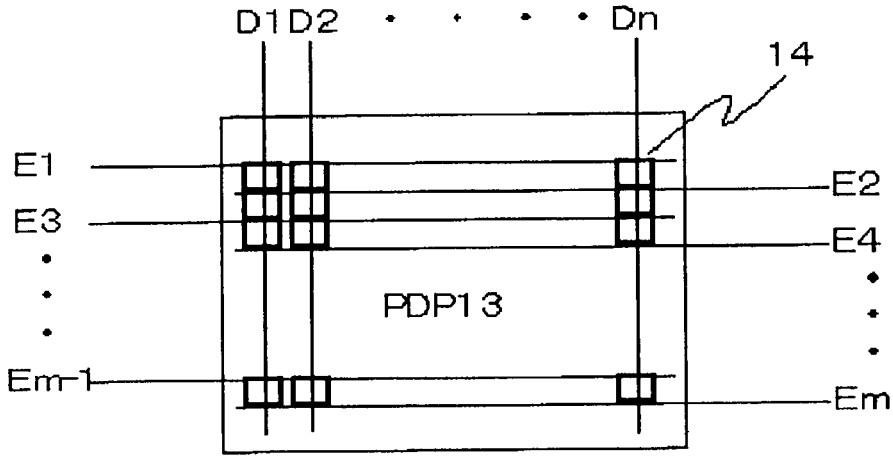
FIG.3 PRIOR ART
FIG. 3 shows the electrode construction of conventional PDP.
Figure 4:
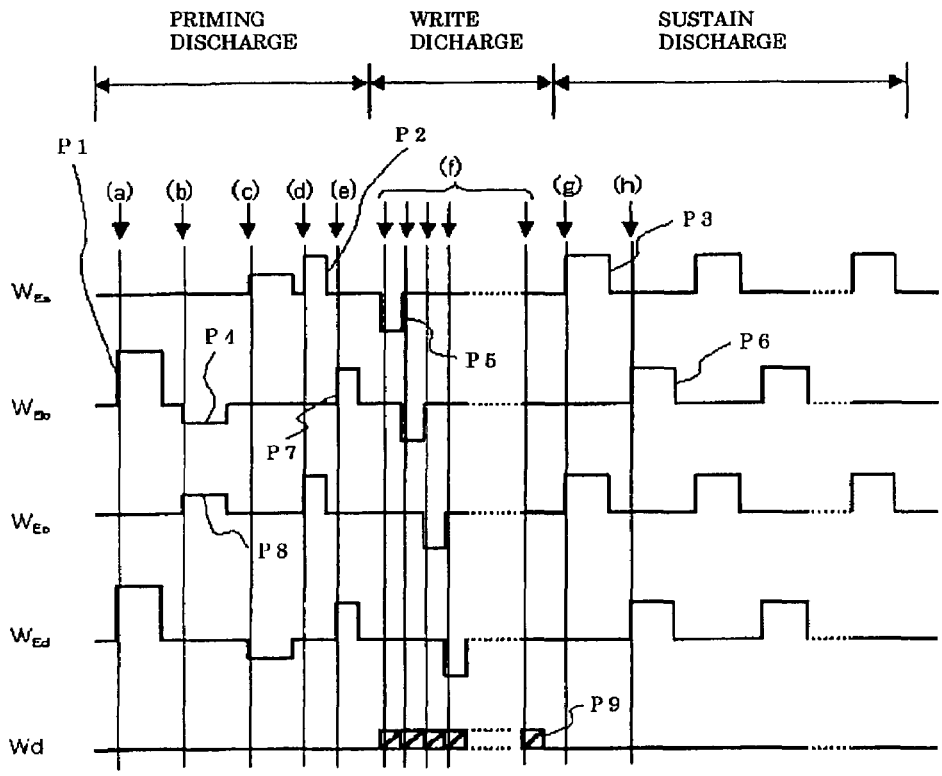
FIG.4 PRIOR ART
FIG. 4 is a drive waveform chart showing the conventional PDP drive method.
Figure 5A:
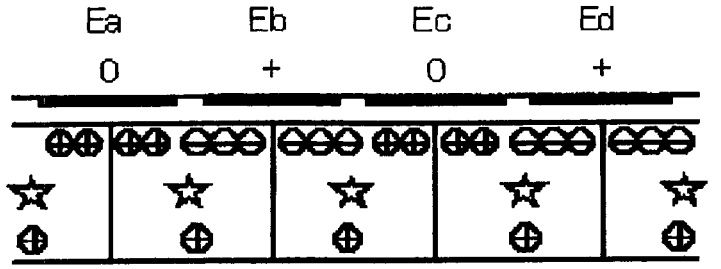
FIG.5A PRIOR ART
FIGS. 5A to 5E are modal drawings of the charge condition change of the priming discharge period in conventional PDP drive method
Figure 5B:
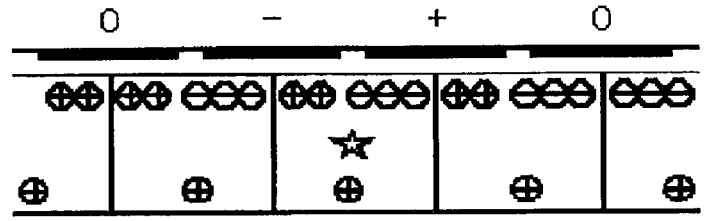
FIG.5B PRIOR ART
Figure 5C:
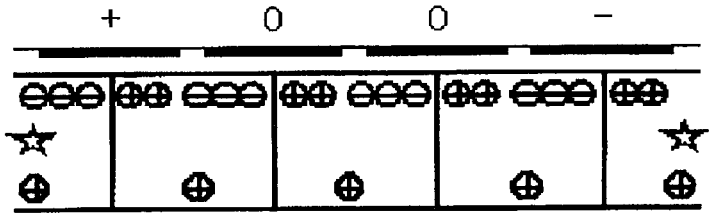
FIG.5C PRIOR ART
Figure 5D:
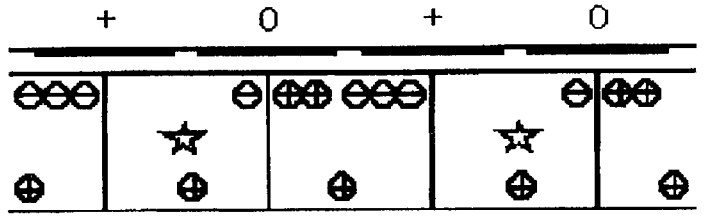
FIG.5D PRIOR ART
Figure 5E:
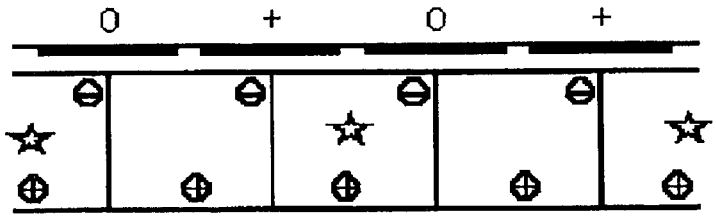
FIG.5E PRIOR ART
Figure 5F:
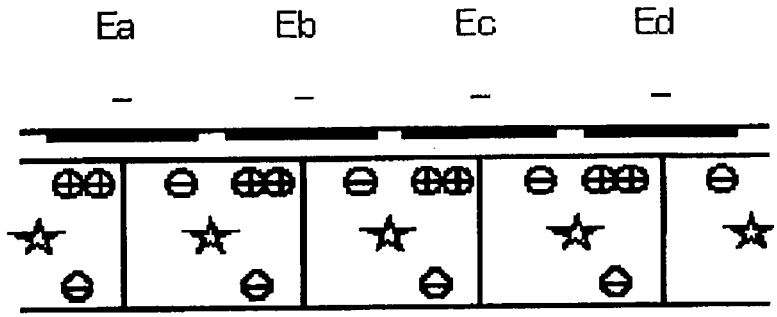
FIG.5F PRIOR ART
FIGS. 5F to 5H are modal drawings of the charge condition change of the write discharge period and sustain discharge period in the conventional PDP drive method.
Figure 5G:
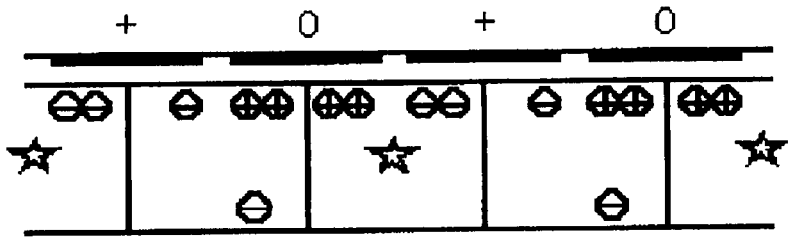
FIG.5G PRIOR ART
Figure 5H:
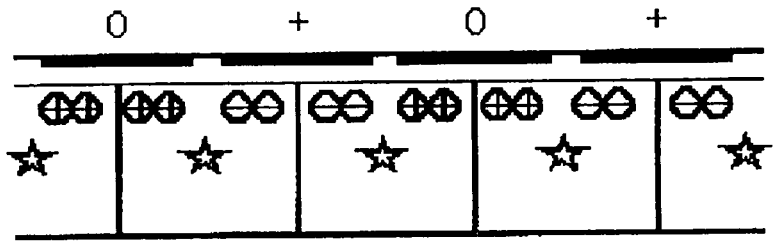
FIG.5H PRIOR ART
Figure 6:
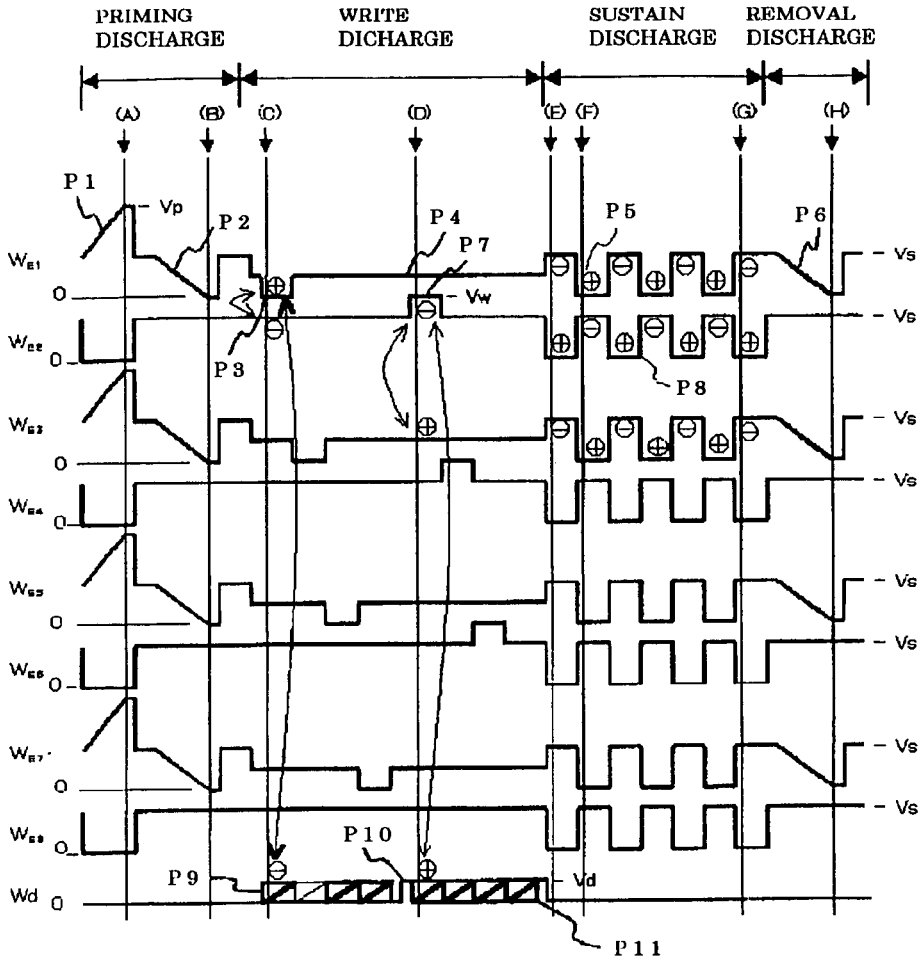
FIG. 6 is a drive waveform chart showing the PDP drive method in accordance with the first embodiment of this invention.
Figure 7A:
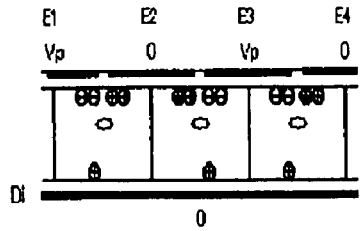
FIGS. 7A to 7H are modal drawings showing the charge condition change in the PDP drive method in accordance with the first embodiment of this invention.
Figure 7B:
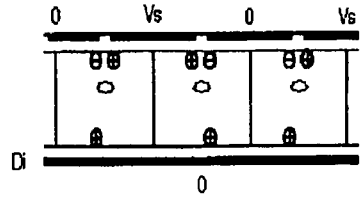
Figure 7C:
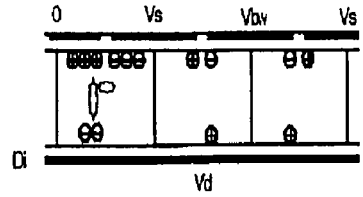
Figure 7D:
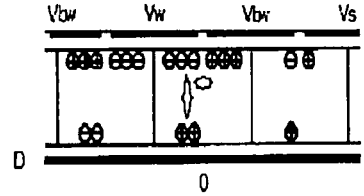
Figure 7E:
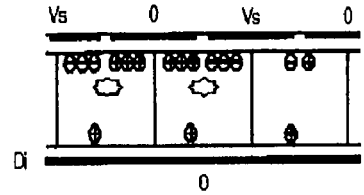
Figure 7F:
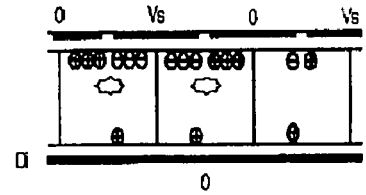
Figure 7G:
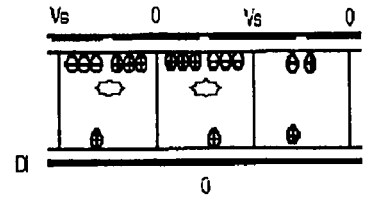
Figure 7H:
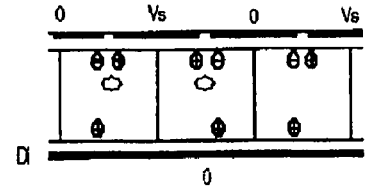

FIG. 6 shows the drive waveform of the first example of embodiment. Here, in order to simplify the explanation, an example of a PDP in which the sustain electrodes consist of 8 stripes is shown.

In FIG. 6, $W_{E1}$, $W_{E2}$, . . . , $W_{E8}$, the drive waveform of the sustain electrodes E1, E2, . . . , E8, and the $W_d$, the drive waveform of the data electrode, are shown.

In the priming discharge period, first, a priming discharge pulse of slowly rising voltage is applied to the odd-numbered sustain electrodes to produce priming discharges in all display cells. Next, after the odd-numbered sustain electrodes are temporarily reduced to a potential about the same as the sustain voltage, a priming discharge elimination pulse of slowly falling voltage is applied.

At this time, if the potential of the even-numbered sustain electrodes has been raised up to about the potential of the sustain voltage, the potentials of the odd-numbered and even-numbered sustain electrodes reverse, and discharges occur. As the potential change of the priming discharge pulse and the priming discharge elimination pulse is slow, if the potential of the display cells is slightly over the discharge start voltage, weak discharges occur. The wall charges so produced are arranged on the electrodes so that, by addition with the externally applied voltage, the potential is slightly lower than the discharge start voltage.

Eventually, for the wall charges produced at the time of priming discharge elimination, in the following write discharge period, by the application or non-application of the data pulses to the data electrodes, the occurrence or non-occurrence of discharges can be selected to eliminate the wall charges.

Moreover, here, the meaning of elimination includes not only the elimination of the wall charges, but also the adjustment of the wall charges, in order to smoothly carrying out the write discharge and the sustain discharge. For the slow voltage changes of the priming discharge pulse and the priming discharge elimination pulse, to sufficiently weaken the discharge at the time, changes below 10 V/$\mu$s are desirable.

In the write discharge period, in its first half, scan pulses are sequentially applied to the odd-numbered sustain electrodes. Furthermore, corresponding to the scan pulses, by applying data pulses to the data electrodes, discharges are produced between the sustain electrodes and the data electrodes.

The scan pulses are applied in the negative direction from the base potential that is the standard, that is, pulses of negative polarity. On the other hand, data pulses are applied in the positive direction from the GND potential that is the standard, that is, pulses of positive polarity.

Moreover, the potential of the even-numbered sustain electrodes is higher than the potential (here, GND potential) of the odd-numbered sustain electrodes under the condition that scan pulses are applied. It induces discharges between the odd-numbered sustain electrodes and the data electrodes, and is made to be a potential that is about that which can produce discharges between the odd-numbered sustain electrodes and the even-numbered sustain electrodes. Specifically, the potential of these even-numbered sustain electrodes is about the voltage of the sustain voltage.

By this write discharge, positive wall charges are accumulated in the odd-numbered sustain electrodes, and negative wall charges are accumulated on the even-numbered sustain electrodes and the data electrodes.

Next, in the second half the write discharge period, scan pulses are sequentially applied to the even-numbered sustain electrode. Furthermore, corresponding to the scan pulses, by applying data pulses to the data electrodes, discharges are produced between the sustain electrodes and the data electrodes. The scan pulses are applied in the positive direction from a base potential that is about the sustain voltage that is the standard, that is, pulses of positive polarity.

On the other hand, data pulses are applied in the negative direction from the data voltage that is the standard, that is, pulses of negative polarity. Moreover, the potential of the odd-numbered sustain electrodes is lower than the potential of the even-numbered sustain electrodes under the condition that scan pulses are applied. It induces discharges between the odd-numbered sustain electrodes and the data electrodes, and is made to be a potential that is about that which can produce discharges between the odd-numbered sustain electrodes and the even-numbered sustain electrodes.

Moreover, specifically, the potential of these even-numbered sustain electrodes is about the voltage of the data voltage, by setting it equal to the standard potential of the data pulse or higher, discharge between odd-numbered sustain electrodes and the data electrodes can be suppressed. By this write discharge, positive wall charges are accumulated on the odd-numbered sustain electrodes and the data electrodes, and negative wall charges are accumulated on the even-numbered sustain electrodes.

As explained above, in display cells where write discharges have occurred, wall charges are formed, and for the wall charges on the sustain electrodes, they are of positive polarity on odd-numbered sustain electrodes, and of negative polarity on even-numbered sustain electrodes. Consequently, in the following sustain discharge period, by alternatively interchanging the potential difference of the odd-numbered sustain electrodes and the even-numbered sustain electrodes, that is, by applying alternatively the sustain pulses, sustain discharges are started at the same time and repeated in all the display cells.

FIG. 6 shows the change of the wall discharges in the case of selective fluorescence in the display cell formed by the sustain electrode E1 and the sustain electrode E2, and the display cell formed by the sustain electrode E2 and the sustain electrode E3, in the write discharge period and the sustain discharge period. Moreover, in the priming discharge period, as discharges occur similarly in all the display cells, the change of wall charges is omitted.

In the last sustain discharge of the sustain discharge period, as the even-numbered sustain electrodes are at GND potential, and the odd-numbered sustain electrodes are at the potential of the sustain voltage, the sustain elimination pulse applies to the odd-numbered sustain electrodes a pulse that slowly drops from the potential of the sustain voltage to the GND potential, to produce weak discharges in display cells in which sustain discharges have occurred, to eliminate the wall charges.

The elimination mentioned here is not limited to eliminating all the wall charges, but includes also adjusting the amount of wall charges that should make the carrying out of the subsequent priming discharge, the write discharge and the sustain discharge smooth.

FIGS. 7A to 7H show the change of the charge condition inside the display cells from priming discharge to sustain removal discharge. FIGS. 7A to 7H correspond to the timings (A) to (H) in FIG. 6.

At timing (A), when a priming pulse of voltage Vp is applied to the odd-numbered sustain electrodes, and at the same time, the even-numbered sustain electrodes are reduced to a 0 V potential discharges occur between the sustain electrodes of all the display cells.

The wall charges are accumulated with a polarity of negative on the odd-numbered sustain electrodes, and positive on the even-numbered sustain electrodes. As the priming discharge pulse is a pulse that rises slowly, the discharge is weak, and the amount of wall charges formed is also small.

At timing (B), a priming discharge elimination pulse that raises the potential of the even-numbered sustain electrodes to a voltage of Vs, and reduces the odd-numbered sustain electrodes slowly to a 0 V potential is applied. The discharge at this time, as the voltage change is slow, is weak and works to reduce the amount of wall charges formed at timing (A).

Timing (C) is the write timing of the first line. The sustain electrode E1 is applied with a scan pulse of negative polarity with reference to voltage Vbw as the standard potential, and reduced to a potential of 0V. Corresponding to this, when the data electrode is raised to a potential of Vd, onto this potential, the wall charges formed in the priming discharge period is superimposed, and supersedes the discharge start voltage, and opposite discharges occur between the sustain electrode E1 and the data electrode.

At this time, as the voltage is raised to the Vs level at the sustain electrode E2, the potential difference between the sustain electrode E1 and the sustain electrode E2 is equal to Vs. Induced by the opposite discharge, surface discharge between the sustain electrodes E1 and E2 also occurs, and eventually, positive, negative and negative wall charges are formed respectively on the sustain electrode E1, the sustain electrode E2 and the data electrode.

Timing (D) is the write timing of the second line. The sustain electrode E2 is applied with a scan pulse of positive polarity with reference to voltage Vs as the standard potential, and raised to a potential of Vw. Corresponding to this, when the data electrode is applied with a data pulse of negative polarity with reference to voltage Vd as the standard potential, and reduced to a potential of 0V, even with consideration of the canceled contribution due to the wall charges formed in the priming discharge period, the discharge start potential is superseded, and opposite discharge occurs between the sustain electrode E2 and the data electrode.

At this time, as the voltage is raised to the Vbw level at the sustain electrode E3, induced by the opposite discharge, surface discharge between the sustain electrodes E1 and E2 also occurs. And eventually, negative, positive, and positive wall charges are formed respectively on the sustain electrode E2, the sustain electrode E3 and the data electrode.

Timing (E) is the timing of the first sustain discharge. If the odd-numbered sustain electrode is put at a voltage of Vs, and the even-numbered sustain electrodes at a voltage of 0 V, in the first line and the second line in which write discharges have occurred, the voltage of the wall charges after the priming discharge is superimposed onto the voltage Vs and supersedes the discharge start voltage, and opposite discharge occurs simultaneously in the two display cells.

As a result, negative, positive and negative wall charges are formed respectively on the sustain electrode E1, the sustain electrode E2 and the sustain electrode E3 of the third line.

At this time, the data electrode is at 0V, as this is at the same potential as the even-numbered sustain electrode of low potential, accompanying the occurrence of sustain discharges, it changes to the condition of accumulation of positive wall charges.

Timing (F) is the second timing of sustain discharge, and timing (G) is the last timing of sustain discharge. As they have respectively potentials opposite to the potential of the sustain electrodes at the time of the previous sustain discharge, sustain discharges of the written-in first line and second line occur.

Timing (H) is the timing of sustain discharge elimination. The voltage of the even-numbered sustain electrodes is raised to Vs, and then to the odd-numbered sustain electrodes, the priming discharge elimination pulse is applied and slowly reduced down to the potential of 0 V. As the discharge is as weak as at the time of priming discharge elimination, and the amount of wall charges decreases, from now on, wall charges are adjusted so that even if a sustain pulse is applied, sustain discharge would not happen.

In the drive waveform shown in FIG. 6 as an example, as the amplitude of the scan pulse of negative polarity in the first half of the write period and that of the scan pulse of the latter half are approximately equal, the application of a scan pulse generation circuit that has a similar voltage tolerance is possible.

Moreover, as the amplitude of the data pulse of positive polarity is about the same as that of the data pulse of negative polarity, the application of a data electrode drive circuit that is optimized with respect to voltage tolerance is easy.

In the foregoing drive method, in the PDP structure showing the conventional technique, the upper and lower display cells that share the sustain electrodes to which scan pulses are applied, in the write timing of one side, in the case that writing is not finished in both of them, both will be selected. Accordingly, carrying out image signal processing that make the neighboring two lines to have the same data will be acceptable.

Figure 8:
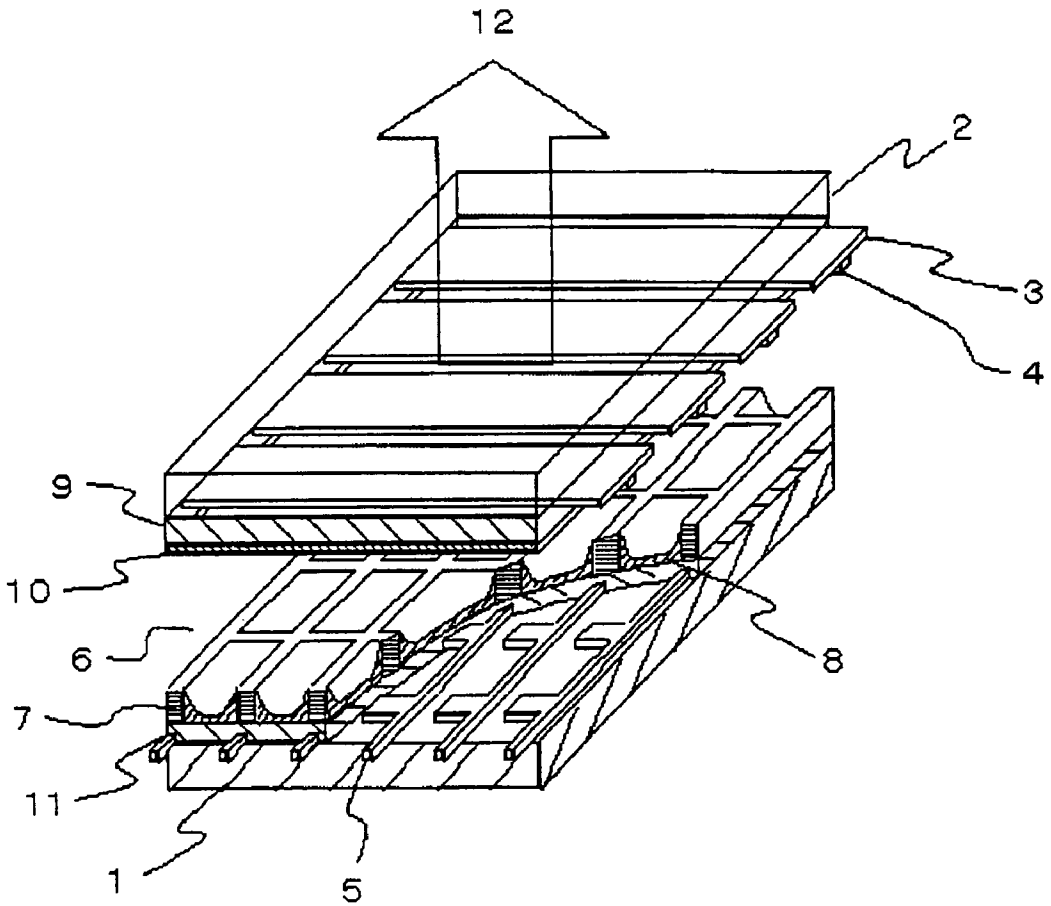
FIG. 8 is a perspective exploded view of the PDP in accordance with the first embodiment of this invention.
Figure 9:
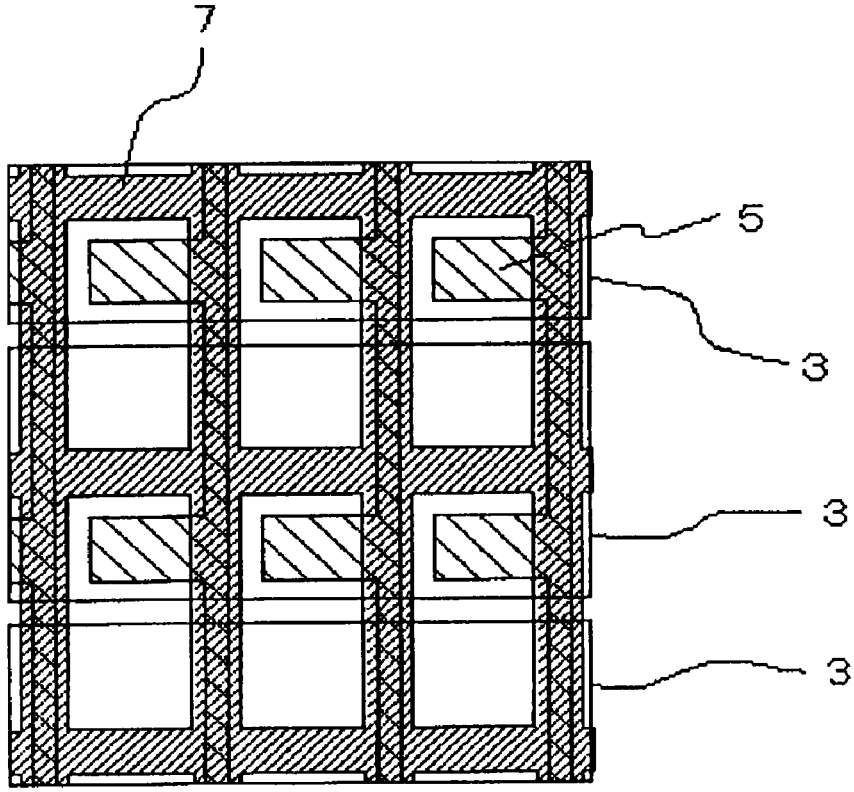
FIG. 9 is a perspective projection of the top plan view showing with an emphasis on the electrodes and separation walls of the PDP in accordance with the first embodiment of this invention.
Figure 10:
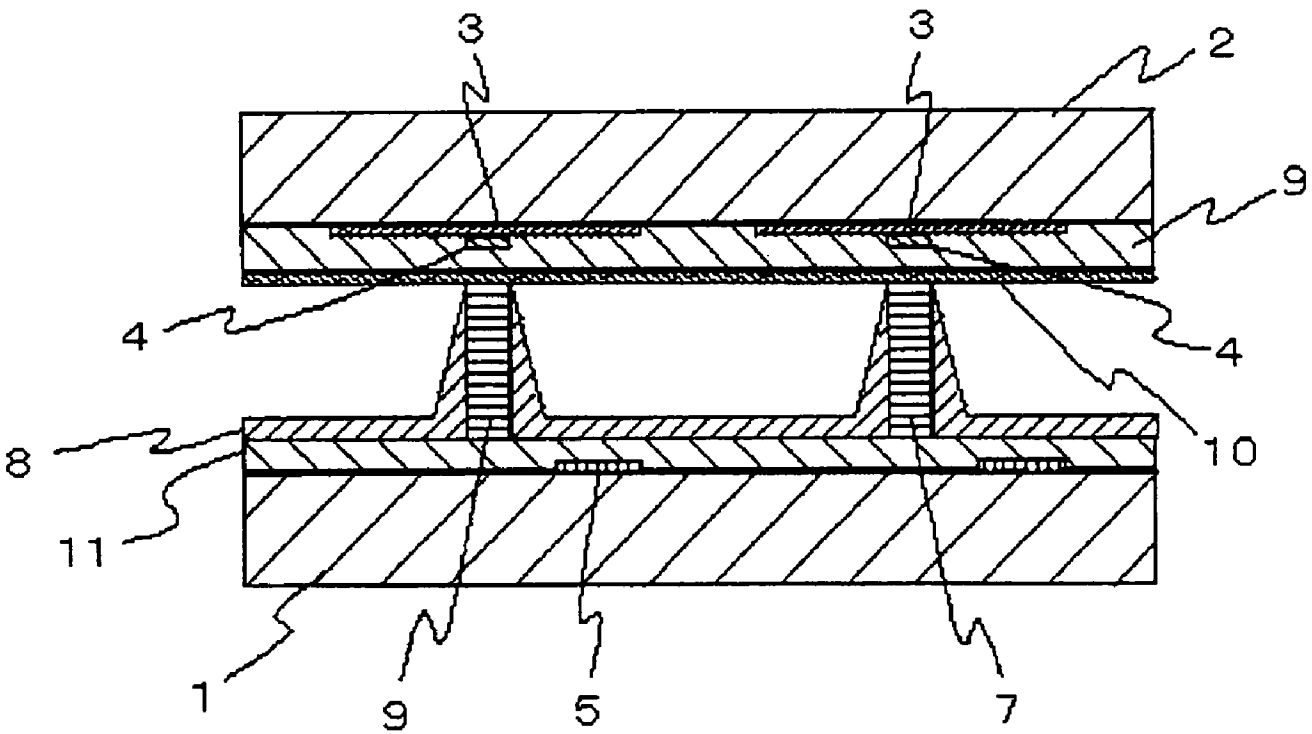
FIG. 10 shows a vertical cross-sectional view of the PDP shown in FIG. 8.

Moreover, to select every display cell completely independently, choose the PDP structures shown in FIGS. 8, 9, and 10, and even better image display can be realized.

FIG. 8 shows a perspective exploded view of the PDP. FIG. 9 is a perspective top plan view seen with an eye on the sustain electrodes, the separation walls and the data electrodes from the display surface side of the PDP. FIG. 10 shows a vertical cross-sectional view.

In the PDP structure of FIGS. 8, 9 and 10, at the position opposite to the sustain electrodes on one side of every display cell (the sustain electrodes are on the upper side in this example), the data electrodes are made into an island form. The bus electrodes 4 that extend in the perpendicular direction connecting the island-formed electrodes are formed underneath the separation walls in the perpendicular direction.

Hence, even if scan pulses are applied to the sustain electrodes 3, as only the display cells positioned below these sustain electrodes are selected, selecting every display cell independently to fluoresce becomes possible.

Moreover, in the write discharge of the latter half of the write discharge period, as the data pulse has negative polarity, the data electrode 5 functions as a cathode. On the sustain electrode 3, not only functioning as a protective layer of the dielectric substance layer 9, MgO, which has a large coefficient of secondary electron emission, is coated as a protection layer 10.

Hence, when impacted by anions, electrons are released from the surface of MgO, and facilitate the occurrence of discharge. By the way, on the data electrode 5, a phosphor 8 is coated. In general, the secondary electron emission coefficients of the phosphors used in PDP are not that large. Moreover, as they readily deteriorate by sputtering when impacted by anions, there are cases where the occurrence of discharges becomes difficult, and life is shortened.

Figure 11:
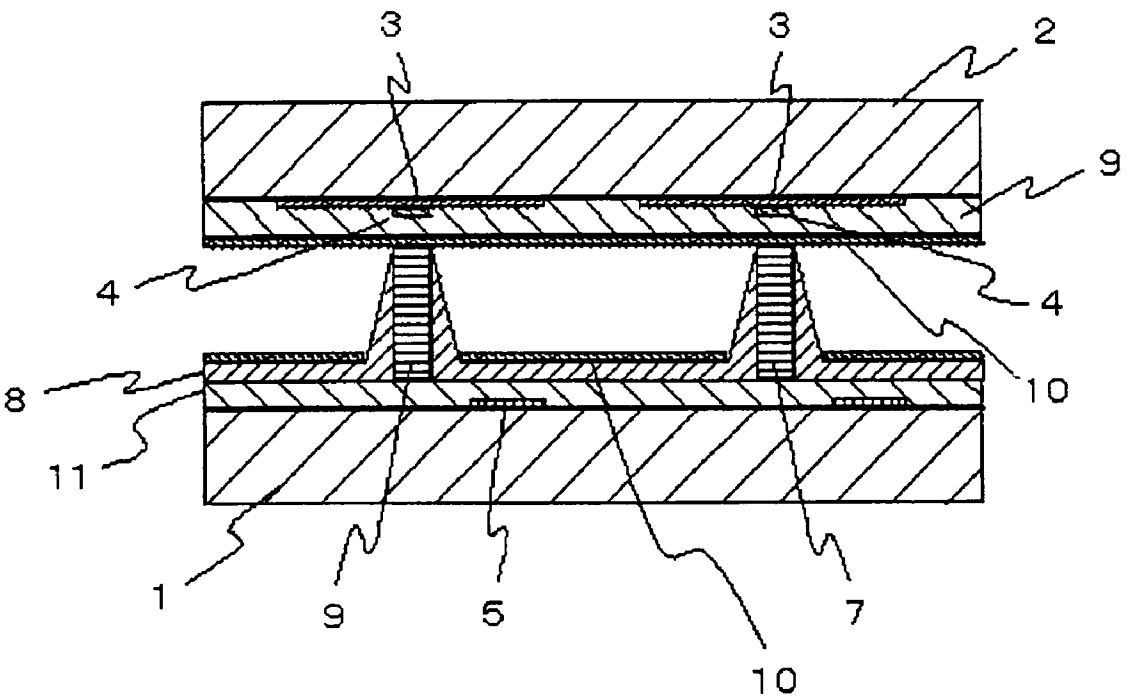
FIG. 11 shows a vertical cross-sectional view of the PDP in accordance with the second embodiment of this invention.
Figure 12:
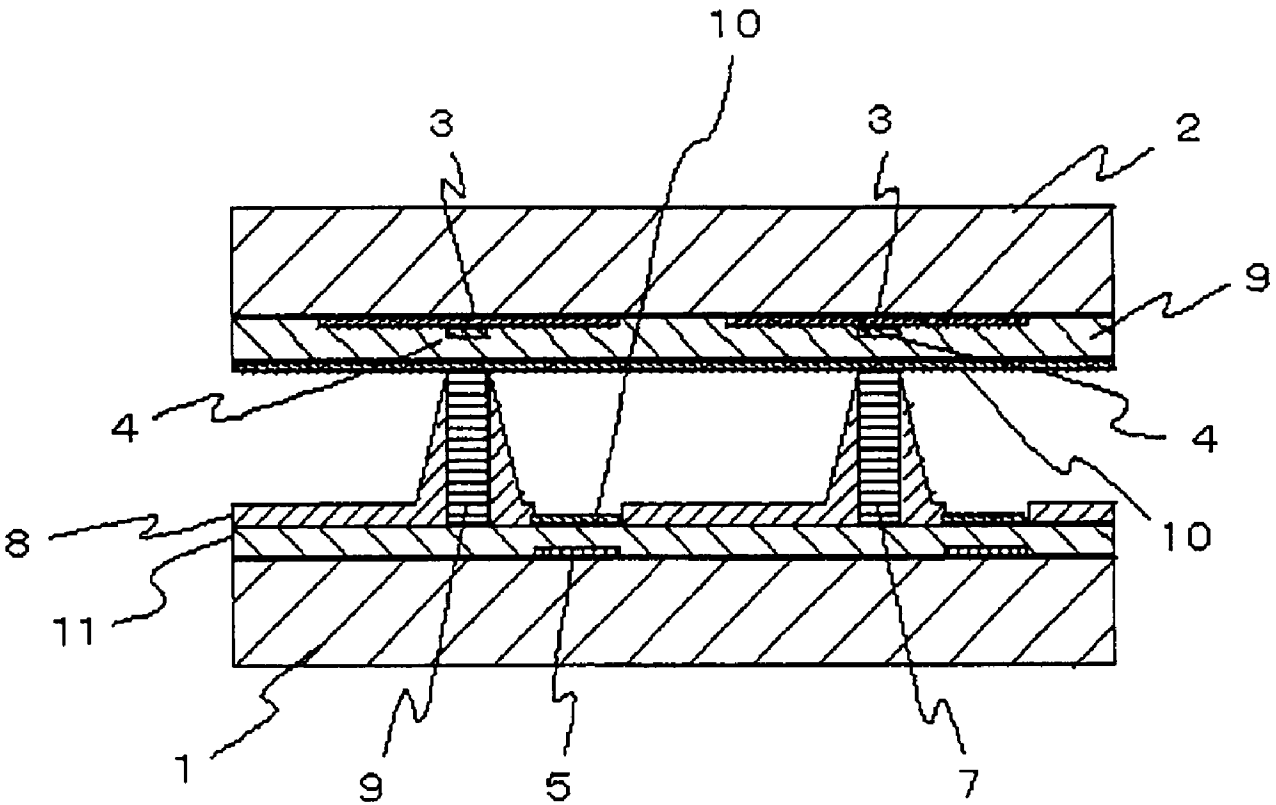
FIG. 12 shows a vertical cross-sectional view of the PDP in accordance with the third embodiment of this invention.

To improve this, as shown in FIG. 11, MgO is coated as a protection layer 10 on the surface of the phosphor 8. Or, as shown in FIG. 12, the PDP is made to have a structure in which, at a part of the area in which write discharge occurs, phosphor is not coated, and MgO is coated as a protection layer 10.

To compensate for the difference in the structures on the sustain electrode and on the data electrode, in the first half of the write discharge period and in the latter half of the write discharge period, changing the standard potential and amplitude of the scan pulse, and the standard potential and amplitude of the data pulse is also an effective means.

In particular, as aforementioned, in the latter half of executing write discharge using the data electrode as the cathode, as the occurrence of the write discharge may be difficult to obtain, by making the amplitude of the scan pulse and the data pulse large, and by applying a larger voltage, the occurrence of write discharge can be facilitated.

Specifically, there should be an increase in the amplitude of the scan pulse applied to the positive direction from the standard potential, and an increase in the potential of the data base pulse and the amplitude of the data pulse. When the potential of the data base pulse is increased, to suppress discharge by mistake between the data base pulse and the scan base pulse, the potential of the scan base pulse should be increase to a similarly high level.

Furthermore, in the above, a drive period is shown to consist of a priming discharge period, a write discharge period, a sustain discharge period, and a sustain removal period as an example. However, setting a priming discharge period for a plurality of a basic drive period is also acceptable. This is because the wall charges formed by the sustain discharge of the previous drive period are removed by the sustain removal discharge and initialized.

In this case, the priming discharge period is mainly set for activating all the display cells periodically, and raising the response speed. In this way, regardless of the display data signals, in all the display cells, the number of priming discharges that generate discharges for fluorescence will be decreased, and the background brightness can be reduced.

Figure 13:
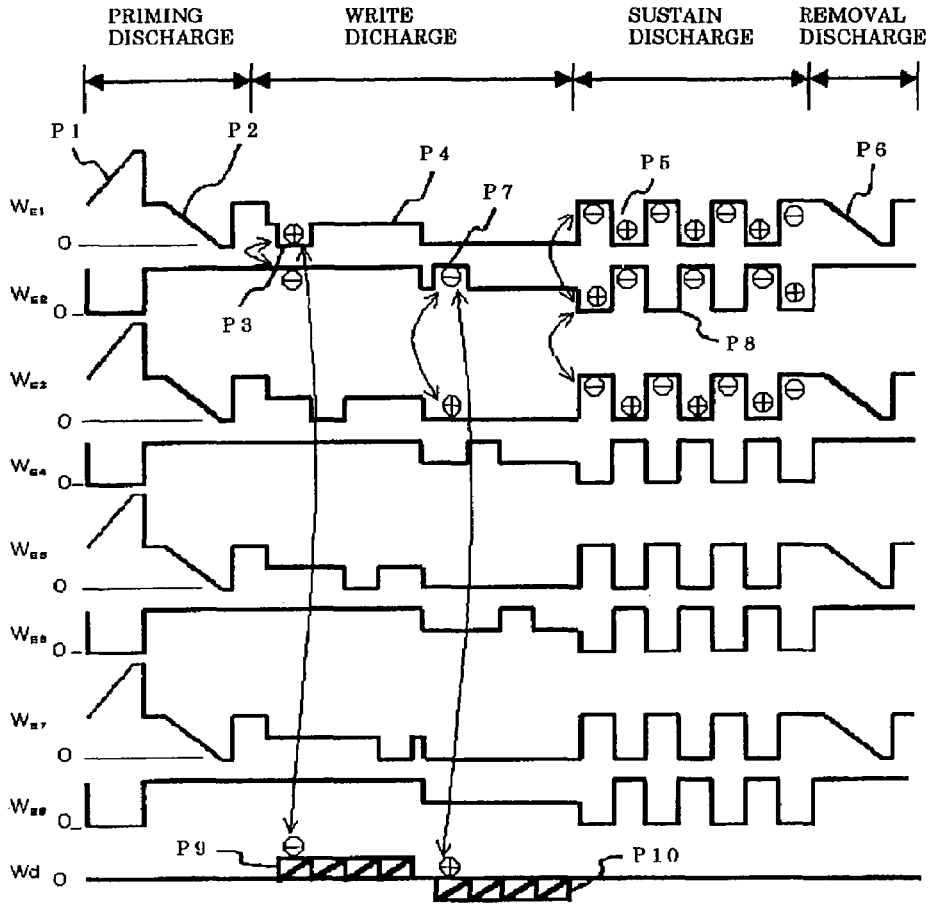
FIG. 13 is a drive waveform chart showing the PDP drive method in accordance with the second embodiment of this invention.

FIG. 13 shows the drive waveform of the second example of embodiment. Here, in order to simplify the explanation, an example of a PDP constituted with 8 stripes of sustain electrodes is shown.

In FIG. 13, $W_{E1}$, $W_{E2}$, . . . , $W_{E8}$, the drive waveform of sustain electrodes E1, E2, . . . , E8, and the $W_d$, drive waveform of data electrode, are shown.

The point that is different from the first embodiment example is the standard potential of the scan pulse of positive polarity in the latter half of the write discharge period, and the standard potential of the data pulse of negative polarity. The standard potential of a scan pulse of positive polarity acts as the potential of the scan base pulse, same as the standard potential of a scan pulse of negative polarity in the first half of the write discharge period.

Moreover, the base potential of the data pulse of negative polarity acts as the GND potential, same as the base potential of a data pulse of positive polarity in the first half of the write discharge period. As the relative potential difference is the same as in the first embodiment example, the change of discharge condition is also the same.

In this second embodiment example, as the potential of the data electrode has the three types of positive data voltage, 0V and negative data voltage, it is necessary to expand the functions of the data electrode drive circuit compared to the first embodiment example. However, the highest potential of the drive pulse of the even-numbered sustain electrodes equals approximately to the sustain voltage, and is lower than the potential of the scan pulse of positive polarity of the first embodiment example. Hence, the drive voltage can be decreased, and the scale of the drive circuit of the even-numbered sustain electrodes can be reduced.

Figure 14:
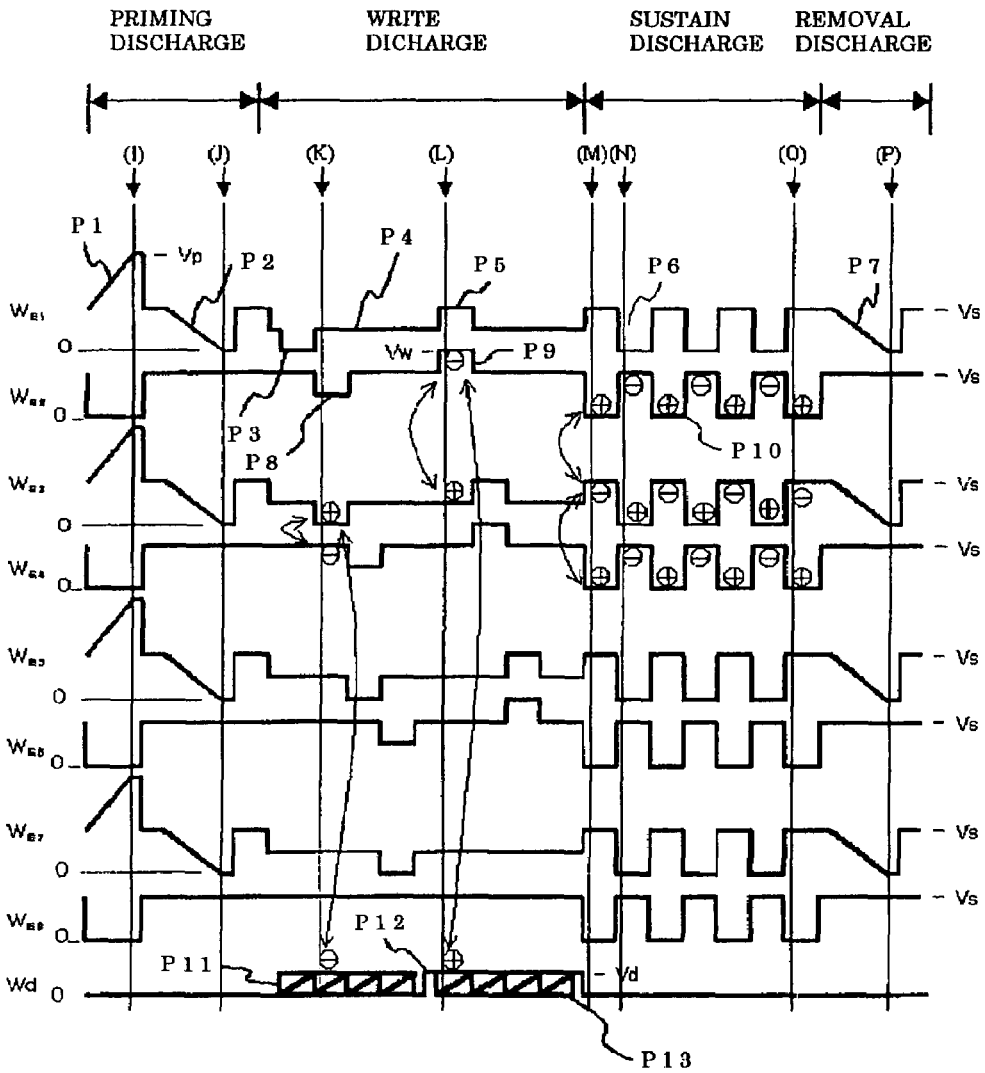
FIG. 14 is a drive waveform chart showing the PDP drive method in accordance with the third embodiment of this invention.
Figure 15A:
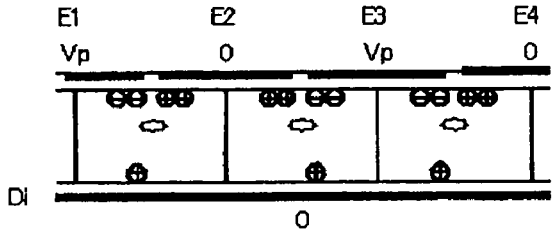
FIGS. 15A to 15H are modal drawings showing the charge condition change in the PDP drive method in accordance with the third embodiment of this invention.
Figure 15B:
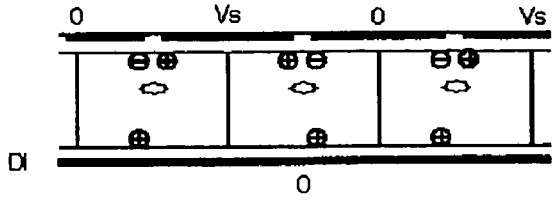
Figure 15C:
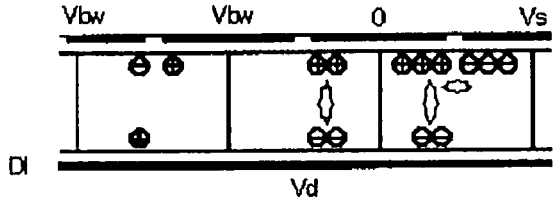
Figure 15D:
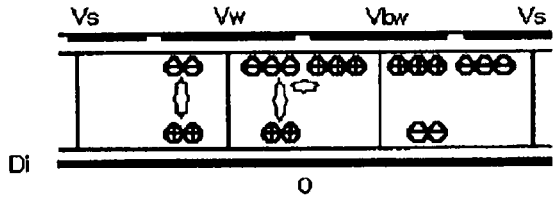
Figure 15E:
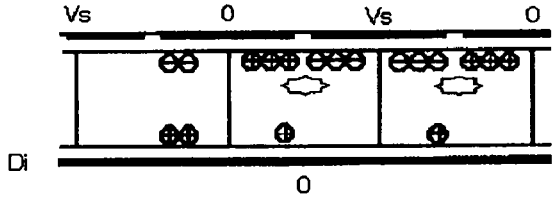
Figure 15F:
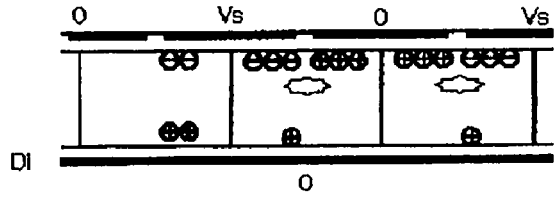
Figure 15G:
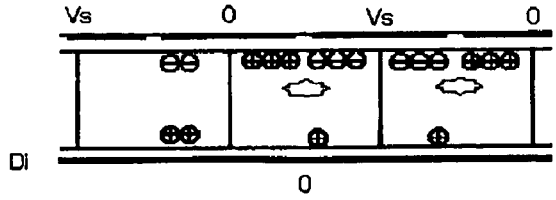
Figure 15H:
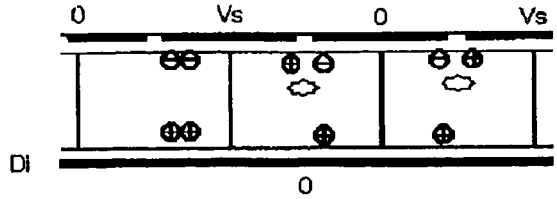

FIG. 14 shows the drive waveform of the third example of embodiment. Here, in order to simplify the explanation, an example of a PDP constituted with 8 stripes of sustain electrodes is shown.

In FIG. 14, $W_{E1}$, $W_{E2}$, . . . , $W_{E8}$, the drive waveform of sustain electrodes E1, E2, . . . , E8, and the $W_d$, drive waveform of data electrode, are shown.

The point that is different from the first example of embodiment is that, in the write discharge period, among the upper and lower display cells that share the sustain electrodes to which scan pulses are applied, on the display cell of one side, to the sustain electrodes of the side to which scan pulse is not applied, write cancel pulse is applied.

For example, when carrying out the writing of the display cells of the third line formed by the sustain electrodes E3 and E4, as is shown at timing (K) in the first half of the write discharge period, a scan pulse of negative polarity is applied to the sustain electrode E3, and at the same time, a write cancel pulse of negative polarity with sustain voltage level as the standard is applied to the sustain electrode E2. To the data electrode, also, a data pulse of positive polarity is applied, and discharge between the sustain electrodes E3 and the data electrode occur.

Induced by this discharge, discharge between the sustain electrodes E3 and E4 also occurs. The so-called surface discharge between sustain electrodes E3 and E4 occurs, because at timing (K), the potential difference of these electrodes is set to be about the sustain voltage.

On the other hand, the potential difference between the similarly neighboring sustain electrodes E2 and E3 is, because of the write cancel pulse, set smaller than, and at about half of, the sustain voltage. Hence, there is no induced discharge between these electrodes, or it is weak if it happens at all.

As a result, on both of the two sustain electrodes that form the display cells of the third line to which writing should be carried out, wall charges are formed. However, the display cells of the second line formed by the sustain electrodes E2 and E3, by discharge between the data electrodes, though wall charges are formed on the sustain electrode E3, they are not formed on sustain electrode E2. In this condition, there will be no sustain discharge in the display cells of the second line, because as long as sufficient wall charges are not formed on both sides of the sustain electrodes forming a pair, it cannot progress to sustain discharge.

We will continue to describe the case of carrying out write discharge of the second line in the second half of the write discharge period.

At timing (L), a scan pulse of positive polarity is applied to the sustain electrode E2, and at the same time, a write cancel pulse of positive polarity with scan base voltage as the standard is applied to the sustain electrode E1.

To the data electrode, a data pulse of negative polarity with the data base pulse of positive voltage as standard is also applied, and discharge between the sustain electrode E2 and data electrode occurs.

In the first half of the write discharge period, though a small amount of wall charges on the sustain electrode E8 have already been formed, induced by this discharge, discharge occurs again between the sustain electrodes E2 and E3, and the amount of wall charges is sufficiently increased for progression to sustain discharge.

At this time, in the case where the display cells of the first line that share the sustain electrode E2 have not been written in, in the first half of the write discharge period, a write cancel pulse is applied to the sustain electrode E1. As the potential difference between the sustain electrodes E1 and E2 is set smaller than, and at about half of, the sustain voltage, there is no induced discharge between these electrodes, or it is weak if it happens at all.

On the other hand, in the case where the display cells of the first line that share the sustain electrode E2 have already been written in, in the first half of the write discharge period, as the second half of the write discharge period is entered into in a condition in which negative wall charges have been formed on the sustain electrode E2 inside the display cells of the first line, discharge does not occur between the data electrode and the sustain electrode E2, and the wall charges due to the first half of the write discharge period are maintained.

Consequently, the writing in of the display cells of the second line is not affected by the conditions after write discharge of the first half of the write discharge period. Moreover, there is no obstruction to the condition of the upper and lower display lines, and the formation of wall charges due to write discharge can be carried out.

On the other hand, in the first half of the write discharge period, in the case where there is no write discharge in the third line that shares one of the sustain electrodes, write discharge is carried out in the charge condition that is initialized by priming discharge.

FIGS. 15A to 15H show the change of the charge condition inside the display cells from priming discharge to sustain removal discharge in the third embodiment example. FIGS. 15A to 15H correspond to timing (I) to (P) in FIG. 14.

Timing (I) is the timing of priming discharge, and timing (J) is the timing of priming discharge removal, but as the change of charge condition is the same as that of the first embodiment example shown in FIGS. 7A to 7H, explanation will be omitted.

Timing (K) is the write timing of the third line. The sustain electrode E3 is applied with a scan pulse of negative polarity with reference to voltage Vbw as the standard potential, and reduced to a potential of 0V. Corresponding to this, when the data electrode is raised to a potential of Vd, onto this potential, the wall charges formed in the priming discharge period is superimposed, and supersedes the discharge start potential, and opposite discharge occurs between the sustain electrode E3 and the data electrode. At the sustain electrode E3 sits astride the display cells of the second line and the display cells of the third line, opposite discharge occurs at both lines.

However, the sustain electrode E2 has a voltage Vbw, and the sustain electrode E4 has a voltage at the Vs level, as and the potential Vbw is lower than the potential Vs, induced by the opposite discharge, surface discharge occurs between the sustain electrodes E3 and E4. Eventually, positive, negative and negative wall charges are formed respectively on the sustain electrode E3, the sustain electrode E4 and the data electrode.

Timing (L) is the write timing of the second line. The sustain electrode E2 is applied with a scan pulse of positive polarity with reference to voltage Vs as the standard potential, and raised to a potential of Vw. Corresponding to this, when the data electrode is applied with a data pulse of negative polarity with reference to voltage Vd as the standard potential, and reduced to a potential of 0V, even with consideration of the part canceled due to the wall charges formed in the priming discharge period, or at the time of write discharge of the foregoing neighboring line, the discharge start potential is superseded, and opposite discharge occurs between the sustain electrode E2 and the data electrode. The sustain electrode E2 sits astride the display cells of the first line and the display cells of the second line and opposite discharge occurs at both lines.

However, the sustain electrode E1 has a voltage of Vs, and the sustain electrode E3 has a voltage at the Vbw level. The potential Vs is higher than the potential Vbw, and as assessed from the difference with the potential Vw of the electrode E2, the potential Vs is lower, induced by the opposite discharge, surface discharge occurs between the sustain electrodes E2 and E3. Eventually, negative, positive and positive wall charges are formed respectively on the sustain electrode E2, the sustain electrode E3 and the data electrode.

Timing (M) is the first sustain discharge timing, timing (N) is the second sustain discharge timing, timing (O) is the last sustain discharge timing, and timing (P) is sustain elimination discharge timing. In the display cells of the second line and the third line in which write discharge has occurred, by the superimposition of the wall charges, sustain discharge occurs, and by sustain elimination discharge, the amount of wall charges decrease.

As this series of operations and changes of charge conditions is similar to the first embodiment example, description will be omitted. At the first line, only opposite discharge occurs at the writing time of the second line, but as surface discharge does not occur, there are insufficient wall charges for progression to sustain discharge.

Needless to say, similar to the first embodiment example, if combining this third embodiment example with the PDP shown in FIG. 3~FIG. 7, even better performance can be obtained. In this case, opposite discharge that writes occurs between the island-formed data electrodes and the sustain electrode parts opposite them. For the parts of the sustain electrodes not opposing the island-formed data electrodes, namely, at the neighboring cells sharing sustain electrodes, opposite discharge basically does not occur. However, when the electrodes or separation walls are deviated from their ideal positional relations, even if some erroneous opposite discharges occur, they can be compensated for.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2000-194295 filed on Jun. 28, 2000 including specification, claims, drawings and summary is incorporated herein by reference in its entirety.

What is claimed is:

1. A method of driving a plasma display panel, the panel comprising:

a plurality of mutually parallel display electrodes including first display electrodes and second display electrodes, the second display electrodes being parallel to and alternating with the first display electrodes, and a plurality of mutually parallel data electrodes perpendicular to the display electrodes, wherein intersection points of the display electrodes and the data electrodes define a plurality of display cells, the method comprising the steps of;

(a) sequentially applying a write discharge pulse of a first potential difference between the first display electrodes and the data electrodes, to the first display electrodes; and (b) sequentially applying a write discharge pulse of a second potential difference, having a polarity opposite that of the first potential difference, between the second display electrodes and the data electrodes, to the second display electrodes.

2. The method as set forth in claim 1, wherein step (a) includes sequentially applying a negative scan pulse having a negative polarity with respect to a first base potential, to the first display electrodes, while applying a positive data pulse having a positive polarity with respect to a second base potential, to the data electrodes; and step (b) includes sequentially applying a positive scan pulse having a positive polarity with respect to a third base potential, to the second display electrodes, while applying a negative data pulse having a negative polarity with respect to a fourth base potential, to the data electrodes.

3. The method as set forth in claim 2, wherein:

the amplitude of the negative scan pulse and the amplitude of the positive scan pulse are different; or the amplitude of the negative data pulse and the amplitude of the positive data pulse are different; or the amplitude of the negative scan pulse and the amplitude of the positive scan pulse are different and the amplitude of the negative data pulse and the amplitude of the positive data pulse are different.

4. The method as set forth in claim 2, wherein:

the third base potential is higher than the first base potential:

the second base potential and the negative data pulse are of equal potential; and the fourth base potential and the positive data pulse are of equal potential.

5. The method as set forth in claim 2, wherein:

the first base potential and the third base potential are equal; and the second base potential and the fourth base potential are equal.

6. The method as set forth in claim 2, further comprising the steps of:

when the negative scan pulse is applied to the first display electrode, applying a write cancel pulse to one of two second display electrodes next to the first display electrode to which the negative scan pulse is applied; and when the positive scan pulse is applied to a second display electrode, applying a write cancel pulse to one of the two display electrodes next to the second display electrode to which the positive scan pulse is applied.

7. The method as set forth in claim 1, further comprising, after all of the write discharge pulses are applied, carrying out, sustain discharges between all of the first display electrodes and neighboring second display electrodes.

8. The method as set forth in claim 1, further comprising, before any write discharge pulses are applied, resetting electrical charge conditions in all display cells.

9. The method as set forth in claim 8, wherein the resetting of the electrical charge conditions includes at least one of a sustain elimination discharge resetting only those display cells that had sustain discharged in a previous sustain discharge period, and a priming discharge causing discharges in all display cells.

10. The method as set forth in claim 9, wherein:

the priming discharge occurs simultaneously in all display cells; and a rate of voltage change of a pulse that causes the priming discharge is below 10 V/$\mu$s.

11. The method as set forth in claim 1, wherein the data electrodes form an island in each display cell, and said island-formed parts are positioned opposite the display electrodes that carry out the write discharges.

12. A apparatus that drives a plasma display panel, comprising:

first and second display electrodes which are alternately disposed with respect to each other;

data electrodes formed perpendicular to the first and second display electrodes; and a control circuit that applies a first write discharge pulse having a first potential difference to the first display electrodes, wherein the first potential difference is a potential difference between the first display electrodes and the data electrodes, wherein the control circuit applies a second write discharge pulse having a second potential difference to the second display electrodes, wherein the second potential difference is a potential difference between the second display electrodes and the data electrodes and has a polarity that is opposite to a polarity of the first potential difference.

13. The apparatus as set forth in claim 12, wherein the control circuit applies the first write discharge pulse by applying a negative scan pulse having a negative polarity with respect to a first base potential, to the first display electrodes, while applying a positive data pulse having a positive polarity with respect to a second base potential, to the data electrodes; and the control circuit applies the second write discharge pulse by applying a positive scan pulse having a positive polarity with respect to a third base potential, to the second display electrodes, which applying a negative data pulse having a negative polarity with respect to a fourth base potential, to the data electrodes.

14. The apparatus as set forth in claim 13, wherein the amplitude of the negative scan pulse and the amplitude of the positive scan pulse are different.

15. The apparatus as set forth in claim 13, wherein the amplitude of the negative data pulse and the amplitude of the positive data pulse are different.

16. The apparatus as set forth in claim 13, wherein the amplitude of the negative scan pulse and the amplitude of the positive scan pulse are different, and wherein the amplitude of the negative data pulse and the amplitude of the positive data pulse are different.

17. The apparatus as set forth in claim 13, wherein the third base potential is higher than the first base potential, wherein the second base potential and the negative data pulse are of equal potential, and wherein the fourth base potential and the positive data pulse are of equal potential.

18. The apparatus as set forth in claim 13, wherein the first base potential and the third base potential are equal, and wherein the second base potential and the fourth base potential are equal.

19. The apparatus as set forth in claim 13, wherein when the control circuit applies the negative scan pulse to a first display electrode, the control circuit applies a write cancel pulse to one of two second display electrodes next to the first display electrode to which the negative scan pulse is applied; and when the control circuit applies the positive scan pulse to a second display electrode, the control circuit applies a write cancel pulse to one of the two first display electrodes next to the second display electrode to which the positive scan pulse is applied.

20. The apparatus as set forth in claim 12, wherein, after all of the write discharge pulses are applied, the control circuit carries out sustain discharges between all of the first display electrodes and neighboring second display electrodes.

21. The apparatus as set forth in claim 12, wherein, before any write discharge pulses are applied, the control circuit establishes resetting electrical charge conditions in all display cells respectively defined by intersection points of the display electrodes and the data electrodes.

22. The apparatus as set forth in claim 21, wherein the resetting of the electrical charge conditions comprises sustain elimination discharge resetting only those display cells that had sustain discharged in a previous sustain discharge period.

23. The apparatus as set forth in claim 21, wherein the resetting of the electrical charge conditions comprises performing a priming discharge causing discharges in all display cells.

24. The apparatus as set forth in claim 23, wherein the priming discharge occurs simultaneously in all display cells; and wherein a rate of voltage change of a pulse that causes the priming discharge is below 10 V/$\mu$s.

25. The apparatus as set forth in claim 12, wherein the data electrodes form an island in each display cell, and wherein said island-formed parts are positioned opposite the display electrodes that carry out the write discharges.

* * * * *